US011166526B2

(12) United States Patent
Baucom et al.

(10) Patent No.: US 11,166,526 B2
(45) **Date of Patent: *Nov. 9, 2021**

(54) ARTICLE OF FOOTWEAR WITH CLEAT ARRANGEMENT INCLUDING ANGLED CLEATS

(71) Applicant: NIKE, Inc., Beaverton, OR (US)

(72) Inventors: Jim Baucom, Portland, OR (US); Joseph Howley, Lake Oswego, OR (US); Morgan Stauffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 16 days.

This patent is subject to a terminal disclaimer.

(21) Appl. No.: 15/466,387

(22) Filed: Mar. 22, 2017

(65) Prior Publication Data

US 2017/0188662 A1 Jul. 6, 2017

Related U.S. Application Data

(63) Continuation of application No. 13/101,582, filed on May 5, 2011, now abandoned.

(51) Int. Cl.
*A43C 15/02* (2006.01)
*A43C 15/04* (2006.01)
(Continued)

(52) U.S. Cl.
CPC ..... *A43C 15/161* (2013.01); *A43B 3/0042* (2013.01); *A43B 3/0068* (2013.01);
(Continued)

(58) Field of Classification Search
CPC .. A43B 5/02; A43B 5/001; A43B 5/00; A43C 15/161; A43C 15/162; A43C 15/16
(Continued)

(56) References Cited

U.S. PATENT DOCUMENTS 1,087,212 A 2/1914 James
1,355,827 A * 10/1920 Finneran ..... A43B 13/223 36/134
(Continued)

FOREIGN PATENT DOCUMENTS

JP S52157936 U 11/1977
JP 2002219006 A 8/2002
(Continued)

OTHER PUBLICATIONS

State Intellectual Property Office, Chinese Office Action for Application No. 201510580557.1, dated Sep. 1, 2016, 25 pages.
(Continued)

*Primary Examiner* — Katharine G Kane
(74) *Attorney, Agent, or Firm* — Honigman LLP; Matthew H. Szalach; Jonathan O'Brien

(57) ABSTRACT

An article of footwear with an arrangement of cleats is disclosed. The arrangement of cleats may enhance traction during the first step of sprinting, quick directional changes, and backward movement. The arrangement of cleats may be disposed on a base plate and may include a first angled cleat aligned with the hallux of a user and a second angled cleat disposed proximate a rearward edge of the base plate. The first angled cleat and two flat cleats may be aligned with the perimeter of a circle on the forefoot region of the base plate.

19 Claims, 4 Drawing Sheets

(51) Int. Cl.

| | |
|---|---|
| ***A43C 15/16*** | (2006.01) |
| ***A43B 5/02*** | (2006.01) |
| ***A43B 3/00*** | (2006.01) |
| ***A43B 13/26*** | (2006.01) |
| ***A43B 13/22*** | (2006.01) |

(52) U.S. Cl.
CPC ..... *A43B 5/02* (2013.01); *A43B 13/223* (2013.01); *A43B 13/26* (2013.01); *A43C 15/02* (2013.01); *A43C 15/04* (2013.01); *A43C 15/162* (2013.01)

(58) Field of Classification Search
USPC ..... 36/67 R, 67 A, 67 B, 67 C, 62 C, 126, 36/127, 128, 129
See application file for complete search history.

(56) References Cited

U.S. PATENT DOCUMENTS

| | | | | | |
|---|---|---|---|---|---|
| 1,617,418 | A | | 2/1927 | Richardson | |
| 2,006,637 | A | | 7/1935 | Goldenberg | |
| 2,406,476 | A | | 8/1946 | Sampson | |
| 2,888,756 | A | | 6/1959 | Neal | |
| 3,526,976 | A | | 9/1970 | Jacobs | |
| 3,656,245 | A | | 4/1972 | Wilson | |
| 3,747,237 | A | | 7/1973 | Wilowski | |
| 4,180,923 | A | | 1/1980 | Dassler | |
| 4,347,674 | A | | 9/1982 | George | |
| 4,392,312 | A | | 7/1983 | Crowley et al. | |
| 4,393,604 | A | | 7/1983 | Crowley | |
| D272,772 | S | * | 2/1984 | Kohno | D2/954 |
| 4,590,693 | A | * | 5/1986 | Kawashima | A43C 15/162 36/126 |
| 4,667,425 | A | | 5/1987 | Effler et al. | |
| D291,743 | S | | 9/1987 | Inohara et al. | |
| D295,231 | S | * | 4/1988 | Heyes | D2/954 |
| D307,211 | S | * | 4/1990 | Aral | D2/955 |
| D322,355 | S | * | 12/1991 | Aral | D2/954 |
| D323,738 | S | | 2/1992 | Eisenbach | |
| D324,763 | S | | 3/1992 | Kayano | |
| 5,201,126 | A | | 4/1993 | Tanel | |
| D351,495 | S | | 10/1994 | Nagai et al. | |
| 5,628,129 | A | * | 5/1997 | Kilgore | A43C 13/04 36/126 |
| D397,850 | S | * | 9/1998 | Harada | D2/959 |
| 5,873,184 | A | | 2/1999 | Ihlenburg | |
| 6,041,461 | A | | 3/2000 | Ogawa et al. | |
| 6,101,746 | A | | 8/2000 | Evans | |
| 6,145,221 | A | * | 11/2000 | Hockerson | A43B 5/02 36/126 |
| 6,457,264 | B2 | | 10/2002 | Fusco et al. | |
| 6,557,270 | B2 | | 5/2003 | Nakano et al. | |
| D476,467 | S | * | 7/2003 | Takamoto | D2/951 |
| 6,948,264 | B1 | * | 9/2005 | Lyden | A43B 5/02 36/134 |
| 6,973,745 | B2 | * | 12/2005 | Mills | A43B 3/0068 36/113 |
| D532,960 | S | | 12/2006 | Pellerin | |
| 7,428,790 | B2 | | 9/2008 | Pellerin | |
| 2004/0000071 | A1 | | 1/2004 | Auger et al. | |
| 2005/0097783 | A1 | | 5/2005 | Mills et al. | |
| 2010/0257756 | A1 | | 10/2010 | Chang | |

FOREIGN PATENT DOCUMENTS

| | | | |
|---|---|---|---|
| JP | 5883502 | B2 | 3/2016 |
| WO | WO-2007138947 | A1 | 12/2007 |

OTHER PUBLICATIONS

Japan Patent Office, Notification of Decision to Grant for Application No. 2014-509434, dated Jan. 12, 2016.
Claims filed with Chinese Divsional Application No. 201410580557.1 dated Sep. 11, 2015.
Japan Patent Office, Office Action for Application No. 2014-509434, dated Mar. 17, 2015.
Response to Office Action filed Jun. 8, 2015 in Chinese Application No. 201280020962.2.
Response to Office Action filed Jun. 12, 2015 in Japanese Application No. 2014-509434.
State Intellectual Property Office, Notice of Allowance dated Jun. 29, 2015 in Chinese Application No. 201280020962.2.
State Intellectual Property Office, First Office Action and Search Report for CN Application No. 201280020962.2, dated Jan. 23, 2015.
English Translation of Notice of Allowance dated Jun. 29, 2015 in Chinese Application No. 201280020962.2.
International Search Report and Written Opinion dated Oct. 12, 2012 in Application No. PCT/US2012/036268.
European Patent Office, Office Action for EP Application No. 12728333.1, dated Jun. 6, 2018.
State Intellectual Property Office (PRC), Office Action for CN Application No. 201510580557.1, dated Apr. 27, 2017.
State Intellectual Property Office (PRC), Office Action for CN Application No. 201510580557.1, dated Mar. 5, 2018.

* cited by examiner

ARTICLE OF FOOTWEAR WITH CLEAT ARRANGEMENT INCLUDING ANGLED CLEATS

CROSS-REFERENCE TO RELATED APPLICATIONS

This application is a continuation of U.S. patent application Ser. No. 13/101,582, filed on May 5, 2011, the disclosure of which is incorporated herein by reference in its entity.

BACKGROUND

The present invention relates generally to an article of footwear and, more particularly, to a sports shoe with cleats.

Articles of footwear having cleats have previously been proposed. While conventional cleats generally help give sports shoes more grip, the cleats do not necessarily optimize traction during the first step of sprinting or when a wearer is moving backward. Moreover, the cleats doe not necessarily provide traction in an optimal way during quick directional changes. It would be advantageous for a sports shoe to have cleats that optimize traction during the first step of sprinting, backward movement, and quick directional changes.

SUMMARY

An article of footwear with an arrangement of cleats is disclosed. In one aspect, the article of footwear may include a base plate including a forefoot region, a heel region, a longitudinal axis extending through the forefoot region and heel region, a forward edge, and a rearward edge. The article of footwear may also include a first cleat disposed on the forefoot region of the base plate. The first cleat may be disposed proximate the forward edge and the medial side. The first cleat may include at least two straight segments forming an angle. The article of footwear may include a second cleat disposed on the heel region of the base plate. The second cleat may be disposed proximate the rearward edge and the longitudinal axis of the base plate. The second cleat may include at least two straight segments forming an angle.

The straight segments of the first cleat may meet at a first point and the first cleat may be oriented so that the first point is directed in a direction between the forward edge and the medial side.

The straight segments of the second cleat may meet at a second point and the second cleat may be oriented so that the second point is directed toward the rearward end.

A third cleat and a fourth cleat may both be disposed on the forefoot region. The first cleat, the third cleat, and the fourth cleat may be arranged so that the first cleat, the third cleat, and the fourth cleat are aligned with a perimeter of a circle that may define a portion of the forefoot region. The third cleat and the fourth cleat may include flat cleats. A fifth cleat may be disposed on the forefoot region within the perimeter of the circle. The third cleat may comprise a flat cleat and the third cleat may be oriented at an angle with respect to the longitudinal axis of the base plate.

In one aspect, the article of footwear may include a base plate including a forefoot region, a heel region, a longitudinal axis extending through the forefoot region and heel region, a forward edge, and a rearward edge. The article of footwear may also include a first cleat disposed on the forefoot region of the base plate. The first cleat may be disposed proximate the forward edge and the medial side. The first cleat may include at least two straight segments forming an angle. The article of footwear may include a second cleat disposed on the forefoot region and a third cleat disposed on the forefoot region. The first cleat, the second cleat, and the third cleat may be arranged so that the first cleat, the second cleat, and the third cleat are aligned with a perimeter of a circle defining a portion of the forefoot region.

The straight segments of the first cleat may meet at a first point and the first cleat may be oriented so that the first point is directed in a direction between the forward edge and the medial side. A fourth cleat may be disposed on the forefoot region within the perimeter of the circle. The fourth cleat may comprise a flat cleat and the fourth cleat may be oriented at an angle with respect to the longitudinal axis of the base plate. A fifth cleat may be disposed at the bottom of the forefoot region and proximate the medial side. A sixth cleat may be disposed at the bottom of the forefoot region and proximate the lateral side.

The second cleat may comprise a flat cleat and the second cleat may be oriented parallel to the longitudinal axis of the base plate. The third cleat may comprise a flat cleat and the third cleat may be oriented at an angle with respect to the longitudinal axis of the base plate.

In one aspect, the article of footwear may include a base plate including a forefoot region, a heel region, a longitudinal axis extending through the forefoot region and heel region, a forward edge, and a rearward edge. The article of footwear may also include a first cleat disposed on the forefoot region of the base plate. The first cleat may be disposed proximate the forward edge and the medial side. The first cleat may include at least two straight segments forming an angle. The article of footwear may include a second cleat disposed on the heel region of the base plate. The second cleat may be disposed proximate the rearward edge and the longitudinal axis of the base plate. The second cleat may include at least two straight segments forming an angle. A third cleat may be disposed on the heel region of the base plate. The third cleat may be disposed opposite the rearward edge and proximate the medial side. The fourth cleat may be disposed on the heel region of the base plate. The fourth cleat may be disposed opposite the rearward edge and proximate the lateral side.

The straight segments of the second cleat may meet at a second point and the second cleat may be oriented so that the second point is directed toward the rearward end. The third cleat may comprise a flat cleat and the third cleat may be oriented at an angle with respect to the longitudinal axis of the base plate. The fourth cleat may comprise a flat cleat and the fourth cleat may be oriented at an angle of approximately 90 degrees with respect to the third cleat.

A fifth cleat may be disposed on the forefoot region. A sixth cleat may be disposed on the forefoot region. The first cleat, the fifth cleat, and the sixth cleat may be arranged so that the first cleat, the fifth cleat, and the sixth cleat are aligned with a perimeter of a circle defining a portion of the forefoot region. A seventh cleat may be disposed at the bottom of the forefoot region and proximate the medial side. An eighth cleat may be disposed at the bottom of the forefoot region and proximate the lateral side.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

An article of footwear having an arrangement of cleats is disclosed. FIGS. 1-4 illustrate an exemplary embodiment of a base plate 102. Base plate 102 may be associated with an article of footwear 100. The following detailed description discusses an exemplary embodiment in the form of a baseball shoe, but it should be noted that the present concept may be associated with any article of footwear, including, but not limited to, soccer boots, rugby shoes, and football shoes. Article of footwear 100 shown in FIGS. 1-4 may be intended to be used with a right foot. However, it should be understood that the following discussing may apply to a mirror image of article of footwear 100 that may be intended to be used with a left foot.

In some embodiments, base plate 102 may be associated with an upper 104. Upper 104 may be attached to base plate 102 by any known mechanism or method. For example, upper 104 may be stitched to base plate 102 or upper 104 may be glued to base plate 102. Upper 104 may be configured to receive a foot. The exemplary embodiment shows a generic design for upper 104. In some embodiments, upper 104 may include another type of design.

Base plate 102 and upper 104 may be made from materials known in the art for making articles of footwear. For example, base plate 102 may be made from elastomers, siloxanes, natural rubber, synthetic rubbers, aluminum, steel, natural leather, synthetic leather, plastics, or thermoplastics. In another example, upper 104 may be made from nylon, natural leather, synthetic leather, natural rubber, or synthetic rubber.

Figure 1:
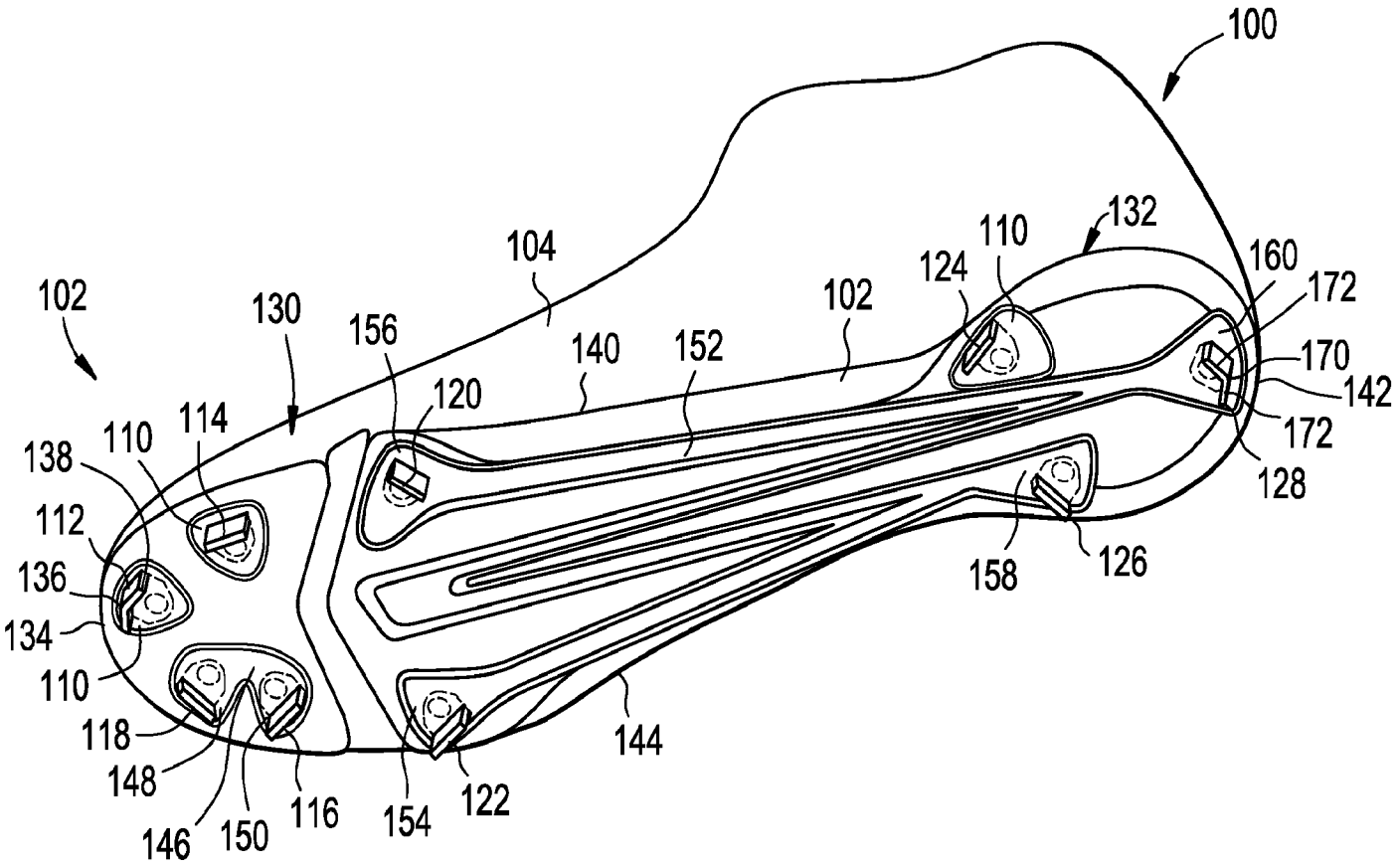
FIG. 1 is an isometric view of an exemplary embodiment of an article of footwear with a base plate with cleats.
Figure 4:
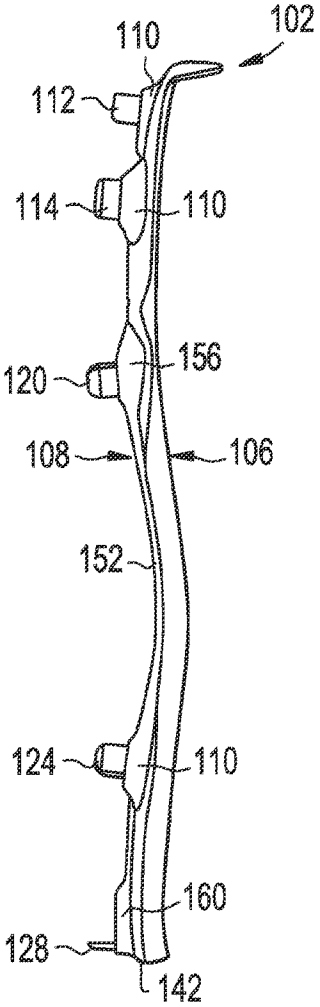
FIG. 4 is a side view of the base plate from a medial side.
Figure 3:
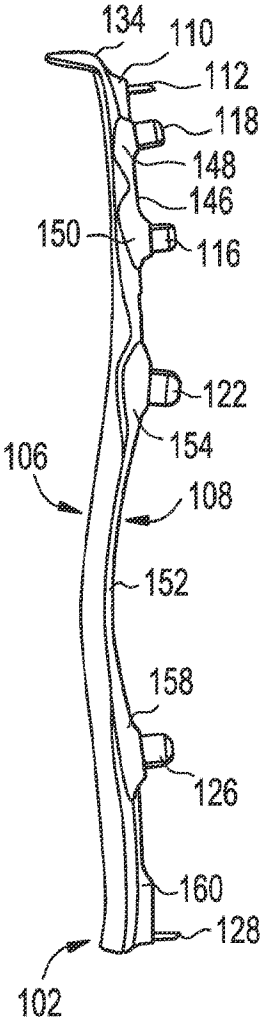
FIG. 3 is a side view of the base plate from a lateral side.
Figure 2:
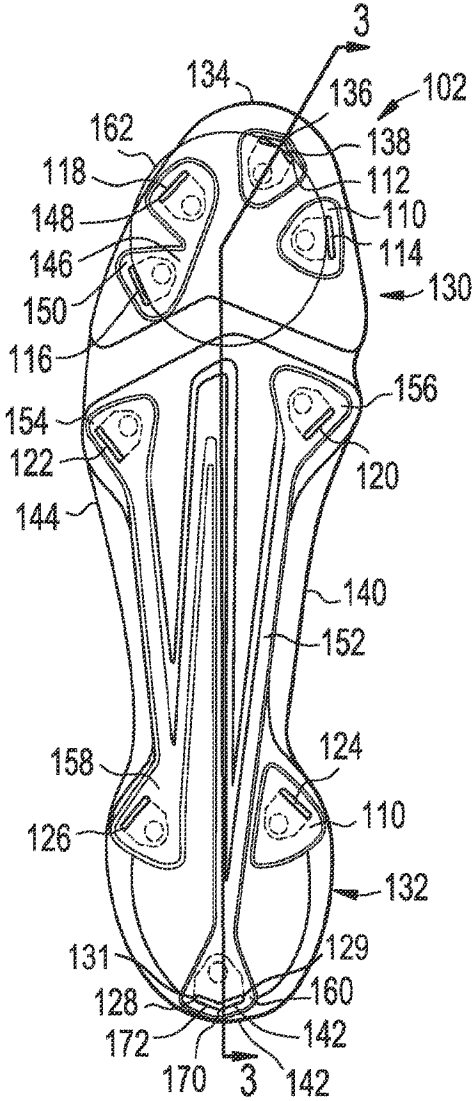
FIG. 2 is a plane view of the base plate of FIG. 1.

For clarity, base plate 102 is shown in isolation in FIGS. 2-4. Base plate 102 may include a top surface 106 and a bottom surface 108. Base plate 102 may be configured to be attached to upper 104. Base plate 102 may also be configured to be attached to a midsole or an insole of an article of footwear. Top surface 106 may be configured to contact the midsole or the insole. Base plate 102 may include a forefoot region 130 disposed proximate a wearer's forefoot. Base plate 102 may include a heel region 132 disposed proximate a wearer's heel and opposite the forefoot region 130. Base plate 102 may include a midfoot region disposed between forefoot region 130 and heel region 132. Base plate 102 may include a medial side 140 and a lateral side 144 opposite medial side 140. Base plate 102 may include a forward edge 134 and a rearward edge 142 disposed opposite forward edge 134.

Bottom surface 108 may be configured to contact a playing surface. For example, bottom surface 108 may be configured to contact grass, synthetic turf, dirt, or sand. Base plate 102 may include provisions for increasing traction with such a playing surface. For example, such provisions may include cleats. Base plate 102 may include cleat receiving members 110, 146, and 152. In some embodiments, cleat receiving members 110, 146, and 152 may be configured to receive removable cleats. In other embodiments, base plate 102 may be associated with molded cleats. For example, base plate 102 may be configured to receive molded cleats. In another example, base plate 102 may include cleats integrally formed with base plate 102 through molding. As shown in FIGS. 1-4, cleat receiving members 110, 146, and 152 may be raised with respect to base plate 102. In other embodiments, cleat receiving members 110, 146, and 152 may be flush with base plate 102.

In some embodiments, the cleat receiving members may be disposed on the forefoot region 130 of base plate 102. In other embodiments, the cleat receiving members may be disposed on the heel region 132 of base plate 102. In some embodiments, the cleat receiving members may be disposed on a midfoot region of base plate 102. In yet other embodiments, the cleat receiving members may be disposed on both the forefoot region 130 and heel region 132 of base plate 102.

A first cleat 112, a second cleat 114, a third cleat 116, a fourth cleat 118, a fifth cleat 120, and a sixth cleat 122 may be disposed on forefoot region 130 of base plate 102. A seventh cleat 124, an eighth cleat 126, and a ninth cleat 128 may be disposed on heel region 132 of base plate 102. This arrangement of cleats may enhance traction for a wearer during cutting, turning, stopping, accelerating, and backward movement. The cleats may be made from materials known in the art for making articles of footwear. For example, the cleats may be made from elastomers, siloxanes, natural rubber, synthetic rubbers, aluminum, steel, natural leather, synthetic leather, plastics, or thermoplastics. In some embodiments, the cleats may be made of the same materials. In other embodiments, the cleats may be made of various materials. For example, first cleat 112 may be made of aluminum while second cleat 114 is made of a thermoplastic material. In some embodiments, the cleats may have the same shape. In other embodiments, the cleat may have different shapes. For example, the exemplary embodiment shown in FIGS. 1-4 illustrates cleats of different shapes. In some embodiments, the cleats may have the same height, width, and/or thickness. In other embodiments, the cleats may have different heights, different widths, and/or different thicknesses.

Cleat receiving members 110, 146, and 152 may be configured to receive cleats or studs of various shapes and sizes. For example, as shown in the exemplary embodiment of FIGS. 1-4, cleat receiving members 110 may be configured to receive first cleat 112, second cleat 114, and seventh cleat 124. In some embodiments, the cleat receiving members may be configured to receive multiple cleats. For example, as shown in the exemplary embodiment of FIGS. 1-4, cleat receiving member 146 may include a cleat receiving portion 148 configured to receive fourth cleat 118 and a cleat receiving portion 150 configured to receive third cleat 116. Cleat receiving member 152 may include a cleat receiving portion 156 configured to receive fifth cleat 120, a cleat receiving portion 154 configured to receive sixth cleat 122, a cleat receiving portion 158 configured to receive eighth cleat 126, and a cleat receiving portion 160 configured to receive ninth cleat 128.

Base plate 102 may include components other than cleats that contact a playing surface and increase traction. In some embodiments, base plate 102 may include traction elements that are smaller than cleats or studs. Traction elements on base plate 102 may increase control for wearer when maneuvering forward on a surface by engaging surface. Additionally, traction elements may also increase the wearer's stability when making lateral movements by digging into playing surface. In some embodiments, traction elements may be molded into base plate 102. In some embodiments, base plate 102 may be configured to receive removable traction elements.

In some embodiments, first cleat 112 may include any known shape. For example, as shown in FIGS. 1-4, first cleat 112 may include an angled shape. The angled shape may enhance a wearer's ability to pivot on first cleat 112, which helps with quickly changing directions. In other words, the angled shape may enhance traction without substantially inhibiting pivoting on forefoot region 130. In some embodiments, first cleat 112 may include two straight segments 138 forming an angle at a point 136, where straight segments 138 connect. In some embodiments, straight segments 138 may be integrally formed together. The angle formed at point 136 may be varied. For example, in some embodiments, the angle formed at point 136 may be within the range of approximately 120 degrees to 140 degrees. In some embodiments, the angle formed at point 136 may be within the range of approximately 125 degrees to 134 degrees. In some embodiments, the angle formed at point 136 may be within the range of approximately 134 degrees to 138 degrees.

The width of straight segments 138 may be varied. For example, in some embodiments, straight segments 138 may have a width within the range of approximately 4 mm and 20 mm. In some embodiments, straight segments may have a width within the range of approximately 7 mm and 12 mm. In some embodiments, straight segments may have a width within the range of approximately 6 mm and 8 mm. In some embodiments, straight segments 138 may have substantially the same width. In some embodiments, straight segments 138 may have different widths. For example, in some embodiments, one of straight segments may have a width of 4 mm while the other of straight segments 138 has a width of 6 mm.

The height of straight segments 138 may be varied. For example, in some embodiments, straight segments 138 may have a height within the range of approximately 4 mm and 20 mm. In some embodiments, straight segments may have a height within the range of approximately 6 mm and 13 mm. In some embodiments, straight segments 138 may have a height within the range of approximately 10 mm and 12.5 mm. In some embodiments, straight segments 138 may have substantially the same height. In some embodiments, straight segments 138 may have different heights. For example, in some embodiments, one of straight segments 138 may have a height of 10 mm and the other of straight segments 138 may have a height of 12 mm.

The thickness of straight segments 138 may be varied. For example, in some embodiments, straight segments 138 may have a thickness within the range of approximately 0.5 mm and 3 mm. In some embodiments, straight segments 138 may have a thickness within the range of approximately 1 mm and 2 mm. In some embodiments, straight segments 138 may have a thickness within the range of approximately 1.7 mm and 1.9 mm. In some embodiments, straight segments 138 may have substantially the same thickness. In some embodiments, straight segments 138 may have different thicknesses. For example, in some embodiments, one of straight segments 138 may have a thickness of 1.7 mm while the other of straight segments 138 has a thickness of 1.9 mm.

In some embodiments, first cleat 112 may include a connector base (shown in hidden lines) for connecting first cleat 112 to base plate 102. In some embodiments, the connector base may be disposed beneath the cleat receiving member. In some embodiments, the connector base may be disposed above the cleat receiving member. In some embodiments, the connector base may be connected to base plate 102 by a removable mechanism, such as a screw. In some embodiments, the connector base may be integrally formed with first cleat 112.

In some embodiments, first cleat 112 may be disposed proximate forward edge 134 of base plate 102. In some embodiments, first cleat 112 may be disposed proximate medial side 140. In some embodiments, first cleat 112 may be offset from the longitudinal axis of base plate 102. Line 3-3 illustrates how first cleat 112 may be offset from the longitudinal axis of base plate 102. Line 3-3 overlays the longitudinal axis of base plate 102 from a rearward edge 142 of base plate 102 to a point 136 on a forefoot region 130 of base plate 102. From point 136, line 3-3 extends at an angle slightly toward medial side 140 of base plate 102. In some embodiments, first cleat 112 may be aligned with the angled portion of line 3-3. In some embodiments, point 136 may be directed toward a direction between forward edge 134 and medial side 140. First cleat 112 may be aligned with the wearer's hallux (big toe) proximate forward edge 134. In some embodiments, first cleat 112 may be oriented such that point 136 of first cleat 112 is directed in the same direction at the angled portion of line 3-3. As described in further detail with reference to FIGS. 7 and 8 below, the placement of first cleat 112 proximate the wearer's hallux may provide traction beneath the hallux during the first step of sprinting or any other motion enhanced by traction beneath the hallux. The angled shape of cleat 112 may enhance directional changes.

First cleat 112, second cleat 114, and third cleat 116 may be arranged to be substantially aligned the perimeter of a circle 162 that may define a portion of forefoot region 130. This arrangement may enhance a wearer's ability to pivot and to shift weight in different directions while maintaining traction.

In some embodiments, second cleat 114 may include any known shape. For example, as shown in FIGS. 1-4, second cleat 114 may include a flat shape formed by a single segment. In some embodiments, second cleat 114 may include a connector base (shown in hidden lines) for connecting second cleat 114 to base plate 102. In some embodiments, the connector base may be disposed beneath the cleat receiving member. In some embodiments, the connector base may be disposed above the cleat receiving member. In some embodiments, the connector base may be connected to base plate 102 by a removable mechanism, such as a screw. In some embodiments, the connector base may be integrally formed with second cleat 114.

The width of second cleat 114 may be varied. For example, in some embodiments, second cleat 114 may have a width within the range of approximately 4 mm and 20 mm.

In some embodiments, second cleat 114 may have a width within the range of approximately 7 mm and 15 mm. In some embodiments, second cleat 114 may have a width within the range of approximately 10 mm and 13.5 mm. The height of second cleat 114 may be varied. For example, in some embodiments, second cleat 114 may have a height within the range of approximately 4 mm and 20 mm. In some embodiments, second cleat 114 may have a height within the range of approximately 6 mm and 13 mm. In some embodiments, second cleat 114 may have a height within the range of approximately 10 mm and 12.5 mm. The thickness of second cleat 114 may be varied. For example, in some embodiments, second cleat 114 may have a thickness within the range of approximately 0.5 mm and 3 mm. In some embodiments, second cleat 114 may have a thickness within the range of approximately 1 mm and 2 mm. In some embodiments, second cleat 114 may have a thickness within the range of approximately 1.7 mm and 1.9 mm.

In some embodiments, second cleat 114 may be positioned proximate medial side 140 of base plate 102. Second cleat 114 may be positioned further away from forward edge 134 than first cleat 112 is positioned. Second cleat 114 may be positioned substantially parallel to the longitudinal axis of base plate 102. This positioning of second cleat 114 may enhance traction during lateral movement as a wearer pushes off or shifts weight in a direction perpendicular to second cleat 114.

In some embodiments, third cleat 116 may include any known shape. For example, as shown in FIGS. 1-4, third cleat 116 may include a flat shape formed by a single segment. In some embodiments, third cleat 116 may include a connector base (shown in hidden lines) for connecting third cleat 116 to base plate 102. In some embodiments, the connector base may be disposed beneath the cleat receiving member. In some embodiments, the connector base may be disposed above the cleat receiving member. In some embodiments, the connector base may be connected to base plate 102 by a removable mechanism, such as a screw. In some embodiments, the connector base may be integrally formed with third cleat 116.

The width of third cleat 116 may be varied. For example, in some embodiments, third cleat 116 may have a width within the range of approximately 4 mm and 20 mm. In some embodiments, third cleat 116 may have a width within the range of approximately 7 mm and 15 mm. In some embodiments, third cleat 116 may have a width within the range of approximately 10 mm and 13.5 mm. The height of third cleat 116 may be varied. For example, in some embodiments, third cleat 116 may have a height within the range of approximately 4 mm and 20 mm. In some embodiments, third cleat 116 may have a height within the range of approximately 6 mm and 13 mm. In some embodiments, third cleat 116 may have a height within the range of approximately 10 mm and 12.5 mm. The thickness of third cleat 116 may be varied. For example, in some embodiments, third cleat 116 may have a thickness within the range of approximately 0.5 mm and 3 mm. In some embodiments, third cleat 116 may have a thickness within the range of approximately 1 mm and 2 mm. In some embodiments, third cleat 116 may have a thickness within the range of approximately 1.7 mm and 1.9 mm.

In some embodiments, third cleat 116 may be positioned proximate lateral side 144 of base plate 102. Third cleat 116 may be positioned further away from forward edge 134 than first cleat 112 and second cleat 114 are positioned. Third cleat 116 may be positioned at an angle with respect to the longitudinal axis of base plate 102. For example, in some embodiments, third cleat 116 may form an angle within the range of approximately 30 degrees to 50 degrees with the longitudinal axis of base plate 102. In some embodiments, third cleat 116 may form an angle within the range of approximately 35 degrees to 45 degrees with the longitudinal axis of base plate 102. In some embodiments, third cleat 116 may form an angle within the range of approximately 40 degrees to 50 degrees with the longitudinal axis of base plate 102. This positioning of third cleat 116 may enhance traction during lateral movement as a wearer pushes off or shifts weight in a direction perpendicular to third cleat 116.

In some embodiments, fourth cleat 118 may include any known shape. For example, as shown in FIGS. 1-4, fourth cleat 118 may include a flat shape formed by a single segment. In some embodiments, fourth cleat 118 may include a connector base (shown in hidden lines) for connecting fourth cleat 118 to base plate 102. In some embodiments, the connector base may be disposed beneath the cleat receiving member. In some embodiments, the connector base may be disposed above the cleat receiving member. In some embodiments, the connector base may be connected to base plate 102 by a removable mechanism, such as a screw. In some embodiments, the connector base may be integrally formed with fourth cleat 118.

The width of fourth cleat 118 may be varied. For example, in some embodiments, fourth cleat 118 may have a width within the range of approximately 4 mm and 20 mm. In some embodiments, fourth cleat 118 may have a width within the range of approximately 7 mm and 15 mm. In some embodiments, fourth cleat 118 may have a width within the range of approximately 10 mm and 13.5 mm. The height of fourth cleat 118 may be varied. For example, in some embodiments, fourth cleat 118 may have a height within the range of approximately 4 mm and 20 mm. In some embodiments, fourth cleat 118 may have a height within the range of approximately 6 mm and 13 mm. In some embodiments, fourth cleat 118 may have a height within the range of approximately 10 mm and 12.5 mm. The thickness of fourth cleat 118 may be varied. For example, in some embodiments, fourth cleat 118 may have a thickness within the range of approximately 0.5 mm and 3 mm. In some embodiments, fourth cleat 118 may have a thickness within the range of approximately 1 mm and 2 mm. In some embodiments, fourth cleat 118 may have a thickness within the range of approximately 1.7 mm and 1.9 mm.

In some embodiments, fourth cleat 118 may be positioned proximate lateral side 144. Fourth cleat 118 may be positioned between third cleat 116 and forward edge 134. Fourth cleat 118 may be positioned further away from forward edge 134 than first cleat 112 is positioned, but closer to forward edge 134 than second cleat 114 is positioned. Fourth cleat 118 may be positioned at an angle with respect to third cleat 116. For example, in some embodiments, fourth cleat 118 may form an angle of approximately 80 degrees with third cleat 116. In some embodiments, fourth cleat 118 may form an angle within the range of approximately 80 degrees to 100 degrees with third cleat 116. In some embodiments, fourth cleat 118 may form an angle within the range of approximately 85 degrees to 95 degrees with third cleat 116. This positioning of fourth cleat 118 may enhance traction during movement in a variety of directions as a wearer pushes off or shifts weight in a direction perpendicular to fourth cleat 118. The proximity and relative angles between third cleat 116 and fourth cleat 118 may enhance traction during lateral movement as a wearer pushes off or shifts weight in a direction perpendicular to second cleat 114.

During such movement, the force caused by the pushing off or shifting may be distributed to both third cleat 116 and fourth cleat 118.

In some embodiments, fifth cleat 120 may include any known shape. For example, as shown in FIGS. 1-4, fifth cleat 120 may include a flat shape formed by a single segment. In some embodiments, fifth cleat 120 may include a connector base (shown in hidden lines) for connecting fifth cleat 120 to base plate 102. In some embodiments, the connector base may be disposed beneath the cleat receiving member. In some embodiments, the connector base may be disposed above the cleat receiving member. In some embodiments, the connector base may be connected to base plate 102 by a removable mechanism, such as a screw. In some embodiments, the connector base may be integrally formed with fifth cleat 120.

The width of fifth cleat 120 may be varied. For example, in some embodiments, fifth cleat 120 may have a width within the range of approximately 4 mm and 20 mm. In some embodiments, fifth cleat 120 may have a width within the range of approximately 7 mm and 15 mm. In some embodiments, fifth cleat 120 may have a width within the range of approximately 10 mm and 13.5 mm. The height of fifth cleat 120 may be varied. For example, in some embodiments, fifth cleat 120 may have a height within the range of approximately 4 mm and 20 mm. In some embodiments, fifth cleat 120 may have a height within the range of approximately 6 mm and 13 mm. In some embodiments, fifth cleat 120 may have a height within the range of approximately 10 mm and 12.5 mm. The thickness of fifth cleat 120 may be varied. For example, in some embodiments, fifth cleat 120 may have a thickness within the range of approximately 0.5 mm and 3 mm. In some embodiments, fifth cleat 120 may have a thickness within the range of approximately 1 mm and 2 mm. In some embodiments, fifth cleat 120 may have a thickness within the range of approximately 1.7 mm and 1.9 mm.

In some embodiments, fifth cleat 120 may be positioned further away from forward edge 134 than fourth cleat 118 is positioned. Fifth cleat 120 may be positioned proximate medial side 140. Fifth cleat 120 may be positioned proximate a bottom of forefoot region 130 of base plate 102. Fifth cleat 120 may be positioned at an angle with respect to the longitudinal axis of base plate 102. For example, in some embodiments, fifth cleat 120 may form an angle within the range of approximately 30 degrees to 50 degrees with the longitudinal axis of base plate 102. In some embodiments, fifth cleat 120 may form an angle within the range of approximately 40 degrees to 45 degrees with the longitudinal axis of base plate 102. In some embodiments, fifth cleat 120 may form an angle within the range of approximately 45 degrees to 50 degrees with the longitudinal axis of base plate 102. This positioning of fifth cleat 120 may enhance traction during lateral movement as a wearer pushes off or shifts weight in a direction perpendicular to fifth cleat 120. In some embodiments, fifth cleat 120 may be positioned substantially parallel with fourth cleat 118. This positioning of fifth cleat 120 may further enhance traction in a direction perpendicular to fifth cleat 120 and fourth cleat 118. This positioning may also enhance traction as weight is shifted from fifth cleat 120 to fourth cleat 118 and vice versa.

In some embodiments, sixth cleat 122 may include any known shape. For example, as shown in FIGS. 1-4, sixth cleat 122 may include a flat shape formed by a single segment. In some embodiments, sixth cleat 122 may include a connector base (shown in hidden lines) for connecting sixth cleat 122 to base plate 102. In some embodiments, the connector base may be disposed beneath the cleat receiving member. In some embodiments, the connector base may be disposed above the cleat receiving member. In some embodiments, the connector base may be connected to base plate 102 by a removable mechanism, such as a screw. In some embodiments, the connector base may be integrally formed with sixth cleat 122.

The width of sixth cleat 122 may be varied. For example, in some embodiments, sixth cleat 122 may have a width within the range of approximately 4 mm and 20 mm. In some embodiments, sixth cleat 122 may have a width within the range of approximately 7 mm and 15 mm. In some embodiments, sixth cleat 122 may have a width within the range of approximately 10 mm and 13.5 mm. The height of sixth cleat 122 may be varied. For example, in some embodiments, sixth cleat 122 may have a height within the range of approximately 4 mm and 20 mm. In some embodiments, sixth cleat 122 may have a height within the range of approximately 6 mm and 13 mm. In some embodiments, sixth cleat 122 may have a height within the range of approximately 10 mm and 12.5 mm. The thickness of sixth cleat 122 may be varied. For example, in some embodiments, sixth cleat 122 may have a thickness within the range of approximately 0.5 mm and 3 mm. In some embodiments, sixth cleat 122 may have a thickness within the range of approximately 1 mm and 2 mm. In some embodiments, sixth cleat 122 may have a thickness within the range of approximately 1.7 mm and 1.9 mm.

In some embodiments, sixth cleat 122 may be positioned further away from forward edge 134 than fourth cleat 118 is positioned. In some embodiments, sixth cleat 122 may be positioned substantially further away from forward edge 134 than fifth cleat 120 is positioned. Sixth cleat 122 may be positioned proximate lateral side 144. Sixth cleat 122 may be positioned proximate a bottom of forefoot region 130 of base plate 102. Sixth cleat 122 may be positioned at an angle with respect to the longitudinal axis of base plate 102. For example, in some embodiments, sixth cleat 122 may form an angle within the range of approximately 30 degrees to 50 degrees with the longitudinal axis of base plate 102. In some embodiments, sixth cleat 122 may form an angle within the range of approximately 40 degrees to 45 degrees with the longitudinal axis of base plate 102. In some embodiments, sixth cleat 122 may form an angle within the range of approximately 45 degrees to 50 degrees with the longitudinal axis of base plate 102. This positioning of sixth cleat 122 may enhance traction during lateral movement as a wearer pushes off or shifts weight in a direction perpendicular to sixth cleat 122.

In some embodiments, sixth cleat 122 may be positioned substantially parallel with third cleat 116. This positioning of sixth cleat 122 may further enhance traction in a direction perpendicular to sixth cleat 122 and third cleat 116. This positioning may also enhance traction as weight is shifted from sixth cleat 122 to third cleat 116 and vice versa. In some embodiments, sixth cleat 122 may be positioned substantially perpendicular to fifth cleat 120. In some embodiments, sixth cleat 122 may be positioned substantially opposite fifth cleat 120. The proximity and relative angles between sixth cleat 122 and fifth cleat 120 may enhance traction during forward movement as a wearer pushes off or shifts weight in a direction substantially opposite forward edge 134. During such movement, the force caused by the pushing off or shifting may be distributed to both sixth cleat 122 and fifth cleat 120. The proximity and relative angles between sixth cleat 122 and fifth cleat 120 may provide traction without inhibiting pivoting on forefoot region 130.

In some embodiments, seventh cleat 124 may include any known shape. For example, as shown in FIGS. 1-4, seventh cleat 124 may include a flat shape formed by a single segment. In some embodiments, fifth cleat 120 may include a connector base (shown in hidden lines) for connecting fifth cleat 120 to base plate 102. In some embodiments, the connector base may be disposed beneath the cleat receiving member. In some embodiments, the connector base may be disposed above the cleat receiving member. In some embodiments, the connector base may be connected to base plate 102 by a removable mechanism, such as a screw. In some embodiments, the connector base may be integrally formed with fifth cleat 120.

The width of seventh cleat 124 may be varied. For example, in some embodiments, seventh cleat 124 may have a width within the range of approximately 4 mm and 20 mm. In some embodiments, seventh cleat 124 may have a width within the range of approximately 7 mm and 15 mm. In some embodiments, seventh cleat 124 may have a width within the range of approximately 10 mm and 13.5 mm. The height of seventh cleat 124 may be varied. For example, in some embodiments, seventh cleat 124 may have a height within the range of approximately 4 mm and 20 mm. In some embodiments, seventh cleat 124 may have a height within the range of approximately 6 mm and 13 mm. In some embodiments, seventh cleat 124 may have a height within the range of approximately 10 mm and 12.5 mm. The thickness of seventh cleat 124 may be varied. For example, in some embodiments, seventh cleat 124 may have a thickness within the range of approximately 0.5 mm and 3 mm. In some embodiments, seventh cleat 124 may have a thickness within the range of approximately 1 mm and 2 mm. In some embodiments, seventh cleat 124 may have a thickness within the range of approximately 1.7 mm and 1.9 mm.

In some embodiments, seventh cleat 124 may be positioned on a heel region 132 of base plate 102. Seventh cleat 124 may be positioned on a heel region 132 of base plate 102 in a position substantially opposite rearward edge 142. Seventh cleat 124 may be positioned proximate medial side 140. Seventh cleat 124 may be positioned at an angle with respect to the longitudinal axis of base plate 102. For example, in some embodiments, seventh cleat 124 may form an angle within the range of approximately 30 degrees to 50 degrees with the longitudinal axis of base plate 102. In some embodiments, seventh cleat 124 may form an angle within the range of approximately 40 degrees to 45 degrees with the longitudinal axis of base plate 102. In some embodiments, seventh cleat 124 may form an angle within the range of approximately 45 degrees to 50 degrees with the longitudinal axis of base plate 102. This positioning of seventh cleat 124 may enhance traction during lateral movement as a wearer pushes off or shifts weight in a direction perpendicular to seventh cleat 124.

In some embodiments, eighth cleat 126 may be positioned on a heel region 132 of base plate 102. Eighth cleat 126 may be positioned on a heel region 132 of base plate 102 in a position substantially opposite rearward edge 142. Eighth cleat 126 may be positioned proximate lateral side 144. In some embodiments, eighth cleat 126 may include any known shape. For example, as shown in FIGS. 1-4, eighth cleat 126 may include a flat shape formed by a single segment. Eighth cleat 126 may be positioned at an angle with respect to the longitudinal axis of base plate 102. For example, in some embodiments, eighth cleat 126 may form an angle within the range of approximately 30 degrees to 50 degrees with the longitudinal axis of base plate 102. In some embodiments, eighth cleat 126 may form an angle within the range of approximately 40 degrees to 45 degrees with the longitudinal axis of base plate 102. In some embodiments, eighth cleat 126 may form an angle within the range of approximately 45 degrees to 50 degrees with the longitudinal axis of base plate 102. This positioning of eighth cleat 126 may enhance traction during lateral movement as a wearer pushes off or shifts weight in a direction perpendicular to eighth cleat 126.

In some embodiments, eighth cleat 126 may be positioned substantially perpendicular to seventh cleat 124. In some embodiments, eighth cleat 126 may be positioned substantially opposite seventh cleat 124. The proximity and relative angles between eighth cleat 126 and seventh cleat 124 may enhance traction during backward movement as a wearer pushes off or shifts weight in a direction substantially opposite rearward edge 142. During such movement, the force caused by the pushing off or shifting may be distributed to both eighth cleat 126 and seventh cleat 124. The proximity and relative angles between eighth cleat 126 and seventh cleat 124 may provide traction without inhibiting pivoting on heel region 132.

In some embodiments, eighth cleat 126 may include a connector base (shown in hidden lines) for connecting eighth cleat 126 to base plate 102. In some embodiments, the connector base may be disposed beneath the cleat receiving member. In some embodiments, the connector base may be disposed above the cleat receiving member. In some embodiments, the connector base may be connected to base plate 102 by a removable mechanism, such as a screw. In some embodiments, the connector base may be integrally formed with eighth cleat 126.

The width of eighth cleat 126 may be varied. For example, in some embodiments, eighth cleat 126 may have a width within the range of approximately 4 mm and 20 mm. In some embodiments, eighth cleat 126 may have a width within the range of approximately 7 mm and 15 mm. In some embodiments, eighth cleat 126 may have a width within the range of approximately 10 mm and 13.5 mm. The height of eighth cleat 126 may be varied. For example, in some embodiments, eighth cleat 126 may have a height within the range of approximately 4 mm and 20 mm. In some embodiments, eighth cleat 126 may have a height within the range of approximately 6 mm and 13 mm. In some embodiments, eighth cleat 126 may have a height within the range of approximately 10 mm and 12.5 mm. The thickness of eighth cleat 126 may be varied. For example, in some embodiments, eighth cleat 126 may have a thickness within the range of approximately 0.5 mm and 3 mm. In some embodiments, eighth cleat 126 may have a thickness within the range of approximately 1 mm and 2 mm. In some embodiments, eighth cleat 126 may have a thickness within the range of approximately 1.7 mm and 1.9 mm.

In some embodiments, ninth cleat 128 may include any known shape. For example, as shown in FIGS. 1-4, ninth cleat 128 may include an angled shape. The angled shape may enhance a wearer's ability to pivot on ninth cleat 128, which helps with quickly changing directions. In other words, the angled shape may enhance traction without substantially inhibiting pivoting on heel region 132. In some embodiments, ninth cleat 128 may include two straight segments 172 extending from a first terminal end 129 of the ninth cleat 128 to a second terminal end 131 of the ninth cleat 128 and forming an angle at a point 170, where straight segments 172 connect. In some embodiments, straight segments 172 may be integrally formed together. The angle formed at point 170 may be varied. For example, in some embodiments, the angle formed at point 170 may be within the range of approximately 120 degrees and 140 degrees. In some embodiments, the angle formed at point 170 may be within the range of approximately 125 degrees and 134 degrees. In some embodiments, the angle formed at point 170 may be within the range of approximately 134 degrees and 138 degrees.

The width of straight segments 172 may be varied. For example, in some embodiments, straight segments 172 may have a width within the range of approximately 4 mm and 20 mm. In some embodiments, straight segments 172 may have a width within the range of approximately 7 mm and 12 mm. In some embodiments, straight segments 172 may have a width within the range of approximately 6 mm and 8 mm. In some embodiments, straight segments 172 may have substantially the same width. In some embodiments, straight segments 172 may have different widths. For example, in some embodiments, one of straight segments 172 may have a width of 4 mm while the other of straight segments 172 has a width of 6 mm.

The height of straight segments 172 may be varied. For example, in some embodiments, straight segments 172 may have a height within the range of approximately 4 mm and 20 mm. In some embodiments, straight segments 172 may have a height within the range of approximately 6 mm and 13 mm. In some embodiments, straight segments 172 may have a height within the range of approximately 10 mm and 12.5 mm. In some embodiments, straight segments 172 may have substantially the same height. In some embodiments, straight segments 172 may have different heights. For example, in some embodiments, one of straight segments 172 may have a height of 10 mm and the other of straight segments 172 may have a height of 12 mm.

The thickness of straight segments 172 may be varied. For example, in some embodiments, straight segments 172 may have a thickness within the range of approximately 0.5 mm and 3 mm. In some embodiments, straight segments 172 may have a thickness within the range of approximately 1 mm and 2 mm. In some embodiments, straight segments 172 may have a thickness within the range of approximately 1.7 mm and 1.9 mm. In some embodiments, straight segments 172 may have substantially the same thickness. In some embodiments, straight segments 172 may have different thicknesses. For example, in some embodiments, one of straight segments 172 may have a thickness of 1.7 mm while the other of straight segments 172 has a thickness of 1.9 mm.

In some embodiments, first ninth cleat 128 may include a connector base (shown in hidden lines) for connecting ninth cleat 128 to base plate 102. In some embodiments, the connector base may be disposed beneath the cleat receiving member. In some embodiments, the connector base may be disposed above the cleat receiving member. In some embodiments, the connector base may be connected to base plate 102 by a removable mechanism, such as a screw. In some embodiments, the connector base may be integrally formed with ninth cleat 128.

In some embodiments, ninth cleat 128 may be positioned proximate rearward edge 142. Ninth cleat 128 may be positioned so that point 170 is proximate the longitudinal axis of base plate. Ninth cleat 128 may be positioned so that point 170 is slightly offset from the longitudinal axis of base plate 102 toward lateral side 144. Ninth cleat 128 may be positioned so that point 170 points toward rearward edge 142. As explained in further detail with reference to FIGS. 6 and 7 below, this positioning may enhance traction during backward movement or when weight is shifted to a wearer's heel.

Seventh cleat 124, eighth cleat 126, and ninth cleat 128 may be arranged on heel region 132 to work together to enhance a wearer's ability to pivot and to shift weight in different directions while maintaining traction.

Figure 5:
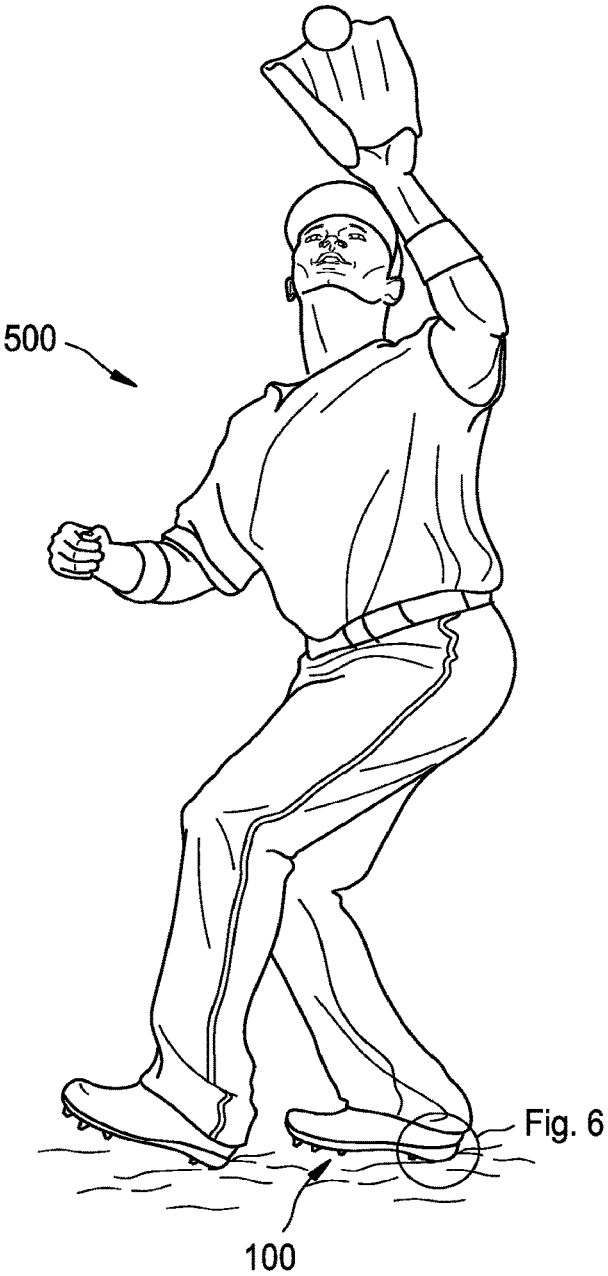
FIG. 5 is a baseball player wearing the article of footwear of FIG. 1 and backing up to catch a ball.
Figure 6:
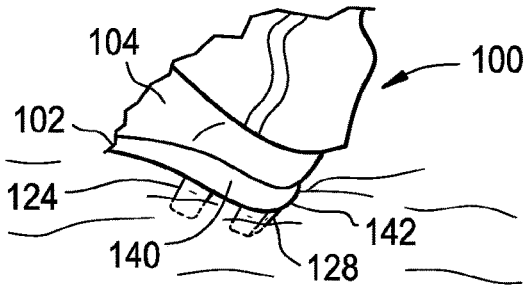
FIG. 6 is a zoomed in view of part of the article of footwear in FIG. 5.

FIG. 5 is a baseball player 500 wearing article of footwear 100 and backing up to catch a ball. As baseball player 500 moves backward, his weight may be shifted to his heels. Seventh cleat 124, eighth cleat 126, and ninth cleat 128 may dig into the ground to enhance traction as baseball player 500 shifts his weight to his heels and moves backward. FIG. 6 is a zoomed in view of part of article of footwear 100 in FIG. 5. FIG. 6 shows medial side 140 as seventh cleat 124 and ninth cleat 128 dig into the ground. The hidden lines show which portions of seventh cleat 124 and ninth cleat 128 may be beneath the ground. The enhanced traction may provide baseball player 500 with more stability and may prevent baseball player 500 from slipping as he moves backward.

Figure 7:
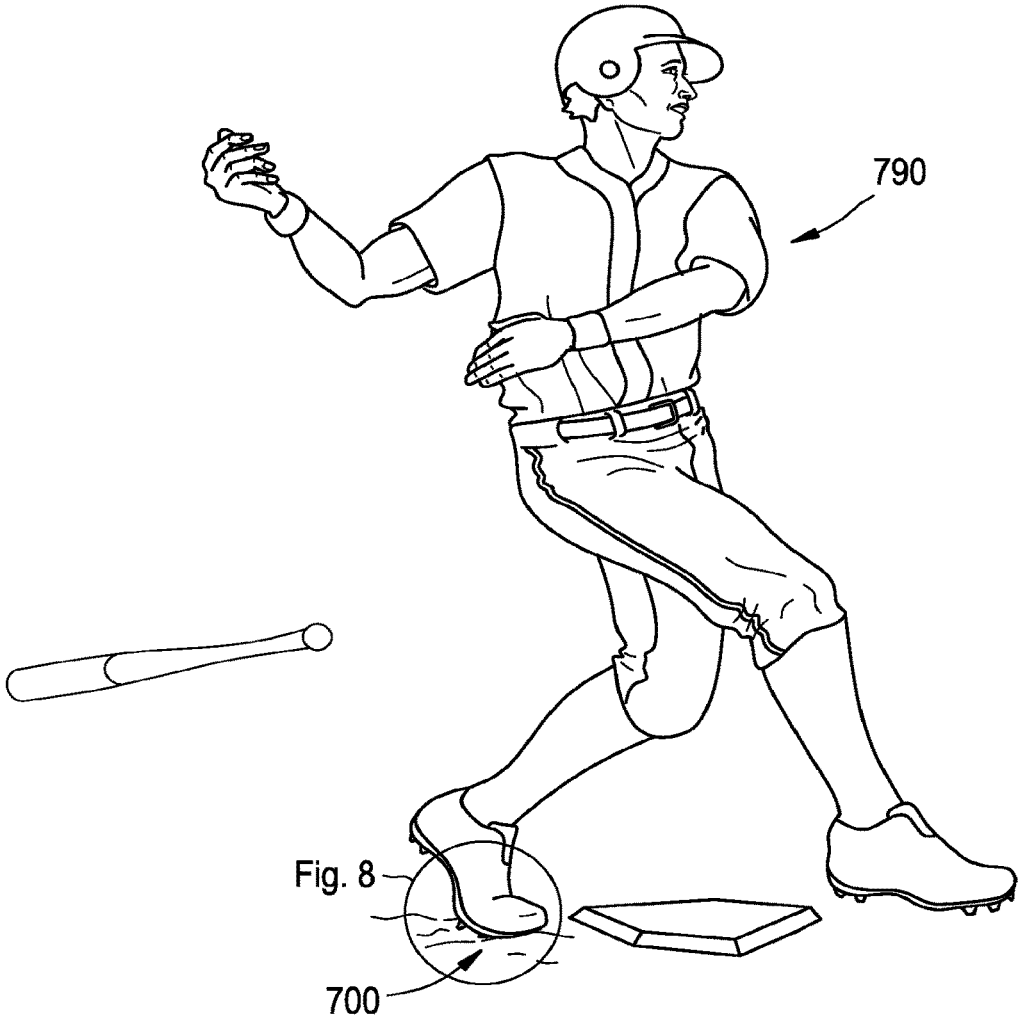
FIG. 7 is a baseball player wearing an exemplary embodiment of an article of footwear and taking off to run after batting.
Figure 8:
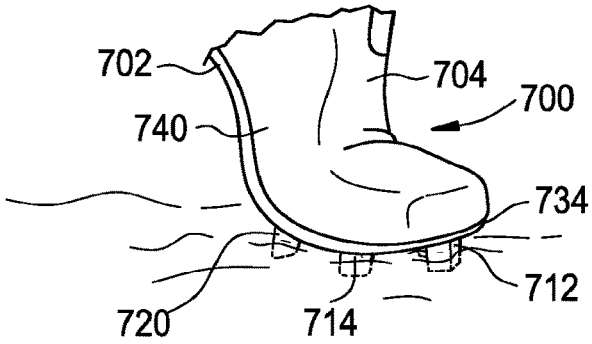
FIG. 8 is a zoomed in view of part of the article of footwear in FIG. 7.

FIG. 7 is a baseball player 790 wearing an article of footwear 700 and taking his first step as he runs away from home plate after batting. Article of footwear 700 may be a left shoe configured as the mirror image of article of footwear 100. Article of footwear 700 may include a base plate 702 having a forward edge 734, a medial side 740, a first cleat 734 similar to first cleat 134, a second cleat 714 similar to second cleat 114, and a third cleat 720 similar to fifth cleat 120. As baseball player 790 moves forward, he plants and pushes of his foot that is wearing article of footwear 700. The weight of baseball player 790 may be shifted to his forefoot. First cleat 734, second cleat 714, and third cleat 720 may dig into the ground to enhance traction as baseball player 790 shifts his weight to his forefoot and moves forward. FIG. 8 is a zoomed in view of part of article of footwear 700 in FIG. 7. FIG. 8 shows first cleat 734, second cleat 714, and third cleat 720 digging into the ground. The hidden lines show which portions of first cleat 734, second cleat 714, and third cleat 720 may be beneath the ground. The enhanced traction may provide baseball player 790 with more stability and may prevent baseball player 790 from slipping as he pushes off his foot wearing article of footwear 700.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

a base plate having a base surface and a length that extends along a longitudinal axis beetween a forward-most edge and a rearward-most edge and through a forefoot region and a heel region;

a first cleat disposed in the forefoot region of the base plate and including a pair of straight segments angled relative to one another and connected at a first point, the first point oriented in a first direction divergent from the longitudinal axis; and a second cleat disposed in the heel region of the base plate and including a pair of straight segments with one of the straight segments extending from a first terminal end of the second cleat and the other of the straight segments extending from a second terminal end of the second cleat, the pair of straight segments angled relative to one another and connected at a common second point with the one of the straight segments of the second cleat extending from the second point to the first terminal end of the second cleat facing a medial side of the base plate and the other of the straight segments of the second cleat extending from the second point to the second terminal end of the second cleat facing a lateral side of the base plate, the longitudinal axis of the base plate extending through the second point, each of the straight segments of the first cleat and the second cleat having a width measured in a first direction parallel to the base surface, a thickness measured in a second direction parallel to the base surface and perpendicular to the width and ranging from 0.5 mm to 3.0 mm, and a height measured perpendicular to the base surface.

2. The article of footwear of claim 1, wherein the first cleat is spaced apart from the longitudinal axis of the base plate.

3. The article of footwear of claim 1, wherein the first cleat is disposed closer to a medial side of the base plate than a lateral side of the base plate.

4. The article of footwear of claim 1, wherein the first direction extends along an axis that extends from the longitudinal axis at an angle and through a medial side of the base plate.

5. The article of footwear of claim 1, wherein the second point opposes the rearward-most edge of the base plate.

6. The article of footwear of claim 1, wherein at least one of the first cleat and the second cleat is integrally formed with the base plate.

7. The article of footwear of claim 1, wherein at least one of the first cleat and the second cleat is removably attached to the base plate.

8. The article of footwear of claim 1, further comprising a third cleat disposed in the forefoot region of the base plate and including a single straight segment that extends along an axis that is substantially parallel to the longitudinal axis of the base plate.

9. The article of footwear of claim 8, wherein the third cleat is disposed closer to a medial side of the base plate than a lateral side of the base plate.

10. An article of footwear comprising:

a base plate having a base surface and a length that extends along a longitudinal axis between a forward-most edge and a rearward-most edge and through a forefoot region and a heel region;

a first cleat disposed in the forefoot region of the base plate at a location closer to a medial side of the base plate than a lateral side of the base plate, the first cleat including a pair of straight segments angled relative to one another and connected at a first point that opposes the medial side of the base plate; and a second cleat disposed in the heel region of the base plate and including a pair of straight segments angled relative to one another and connected to each other at a second point, each of the straight segments extending from the second point to a distal end defining a respective terminal end of the entire second cleat, the longitudinal axis passing through the second point and between the straight segments, each of the straight segments of the first cleat and the second cleat having a width measured in a first direction parallel to the base surface, a thickness measured in a second direction parallel to the base surface and perpendicular to the width and ranging from 0.5 mm to 3.0 mm, and a height measured perpendicular to the base surface, the angled relationship of the straight segments of the second cleat being operable allow the base plate to pivot on the heel region.

11. The article of footwear of claim 10, wherein the first point opposes a perimeter of the base plate at a location that is between the forward-most edge and the rearward-most edge.

12. The article of footwear of claim 10, wherein the second point opposes the rearward-most edge of the base plate.

13. The article of footwear of claim 10, wherein one of the pair of straight segments of the first cleat extends from the first point toward the lateral side of the base plate.

14. The article of footwear of claim 10, further comprising a third cleat disposed in the forefoot region of the base plate and closer to the medial side of the base plate than the lateral side of the base plate, the third cleat including a single straight segment that extends substantially parallel to the longitudinal axis of the base plate.

15. The article of footwear of claim 14, wherein the third cleat is disposed further away from the forward-most edge than the first cleat.

16. The article of footwear of claim 14, further comprising a fourth cleat disposed in the forefoot region of the base plate and closer to the lateral side of the base plate than the medial side of the base plate, the fourth cleat including a single straight segment having a longitudinal axis that is convergent with the longitudinal axis of the base plate.

17. The article of footwear of claim 16, wherein the fourth cleat is disposed further away from the forward-most edge than the first cleat.

18. The article of footwear of claim 16, further comprising a fifth cleat disposed in the forefoot region of the base plate and closer to the lateral side of the base plate than the medial side of the base plate, the fifth cleat including a single straight segment having a longitudinal axis that is convergent with the longitudinal axis of the fourth cleat and the longitudinal axis of the base plate.

19. The article of footwear of claim 18, wherein the fifth cleat is disposed closer to the forward-most edge than the fourth cleat.

* * * * *